US005647208A

United States Patent [19]

Spitzbarth

[11] Patent Number: 5,647,208

[45] Date of Patent: Jul. 15, 1997

[54] HYDRAULIC PUMPING UNIT

[75] Inventor: Joachim Kurt Friedrich Spitzbarth, Rio de Janeiro, Brazil

[73] Assignee: Erry P. Oudang, Jakarta, Indonesia

[21] Appl. No.: 591,764

[22] Filed: Jan. 25, 1996

[51] Int. Cl.[6] ..... F16D 31/02

[52] U.S. Cl. ..... 60/371; 60/381; 60/414; 60/431; 60/446

[58] Field of Search ..... 60/413, 414, 431, 60/432, 446, 447, 371, 372, 381

[56] References Cited

U.S. PATENT DOCUMENTS

| | | | |
|---|---|---|---|
| 3,305,195 | 2/1967 | Eickmann | 60/413 X |
| 3,675,112 | 7/1972 | Smith | 60/413 X |
| 3,713,291 | 1/1973 | Kubik | 60/446 |
| 3,748,857 | 7/1973 | Heiser | 60/446 X |
| 3,867,846 | 2/1975 | Cambern | 60/431 X |
| 3,952,513 | 4/1976 | Kubik | 60/446 X |
| 4,098,144 | 7/1978 | Besel et al. | 60/413 X |
| 4,364,230 | 12/1982 | Holmes | 60/447 X |
| 4,707,988 | 11/1987 | Palmers | 60/413 |
| 4,819,429 | 4/1989 | Kordak | 60/447 X |
| 4,848,085 | 7/1989 | Rosman | 60/381 X |

*Primary Examiner*—John Ryznic
*Attorney, Agent, or Firm*—Selitto & Associates

[57] ABSTRACT

A Hydraulic Pumping Unit equipped with a flywheel, a high-slip electric motor and a reversible hydraulic pump such that during the downstroke of the Unit, the hydraulic pump operates as a hydraulic motor, accelerating the flywheel and accumulating in this way the energy of the downgoing rodstring in the form of kinetic energy.

The interaction between the flywheel, electric motor and weight of the rodstring adjusts automatically the range of speed variation.

The upward and downward speeds of the Hydraulic Pumping Unit can be adjusted by hand or automatically by electronically commanded step motors, in such a way that the Hydraulic Pumping Units adjusts itself to the varying conditions of the oilwell.

5 Claims, 4 Drawing Sheets

HYDRAULIC PUMPING UNIT

BACKGROUND AND SUMMARY OF THE INVENTION

The present invention refers to an Hydraulic Pumping Unit, for the use in oilwells, characterized by the use of an kinetic energy accumulation system, to compensate the upward and downward moving masses of the rod strings.

The Hydraulic Pumping Units are often used in oilwells because they present operational advantages as compared with the conventional mechanical pumping unit. The even and straight movement of the hydraulic piston can be transmitted immediately to the string of sucker rods, without the use of gears and transmission belts. Because of the small weight of the Hydraulic Pumping Unit, the same can be mounted directly on the wellhead flange, avoiding in this way the need for the heavy bases necessary with mechanical pumping units. Stroke length and speed can be easily adjusted without the loss of time to change belt pulleys, and the absence of gear reducers, roller bearings and belt-drives helps to reduce the cost of maintenance, It must be mentioned also, that the initial cost of the Hydraulic Pumping Unit is normally much smaller than that of an mechanical unit.

In spite of the advantages mentioned above, and the apparent simplicity of the Hydraulic Pumping Unit in its actual configuration, the same presents some operational problems which are the causes of frequent failures of operation and increased cost of maintenance.

In the first place, the problem of balancing of the moving masses, which is solved at the mechanical unit with simple rotating counterweights, must be mentioned.

Almost all of the Hydraulic Pumping Units actually in operation, use one of the following systems for balancing:

1 Use of hydraulic accumulators with floating piston or with an elastic bladder, both of them with pre-charge of high pressure nitrogen. This system presents the inconvenience to need frequent recalibration of the nitrogen pressure. Also, the floating piston gets easily stuck, due to the small pressure differential between oil and nitrogen, and the lifetime of the elastic bladder is not long enough to be satisfactory for the conditions at oilfields.

2 Different configurations of pulleys, cables or chains, moving mechanically guided carriers for counterweights, are also used for balancing of Hydraulic Pumping Units, but the introductions of all these elements increase considerably the cost of maintenance.

With the intention to solve the inconveniences mentioned above, the present invention was developed in accordance with the disposition shown in the annexed drawings and the following detailed description.

Figure 1:
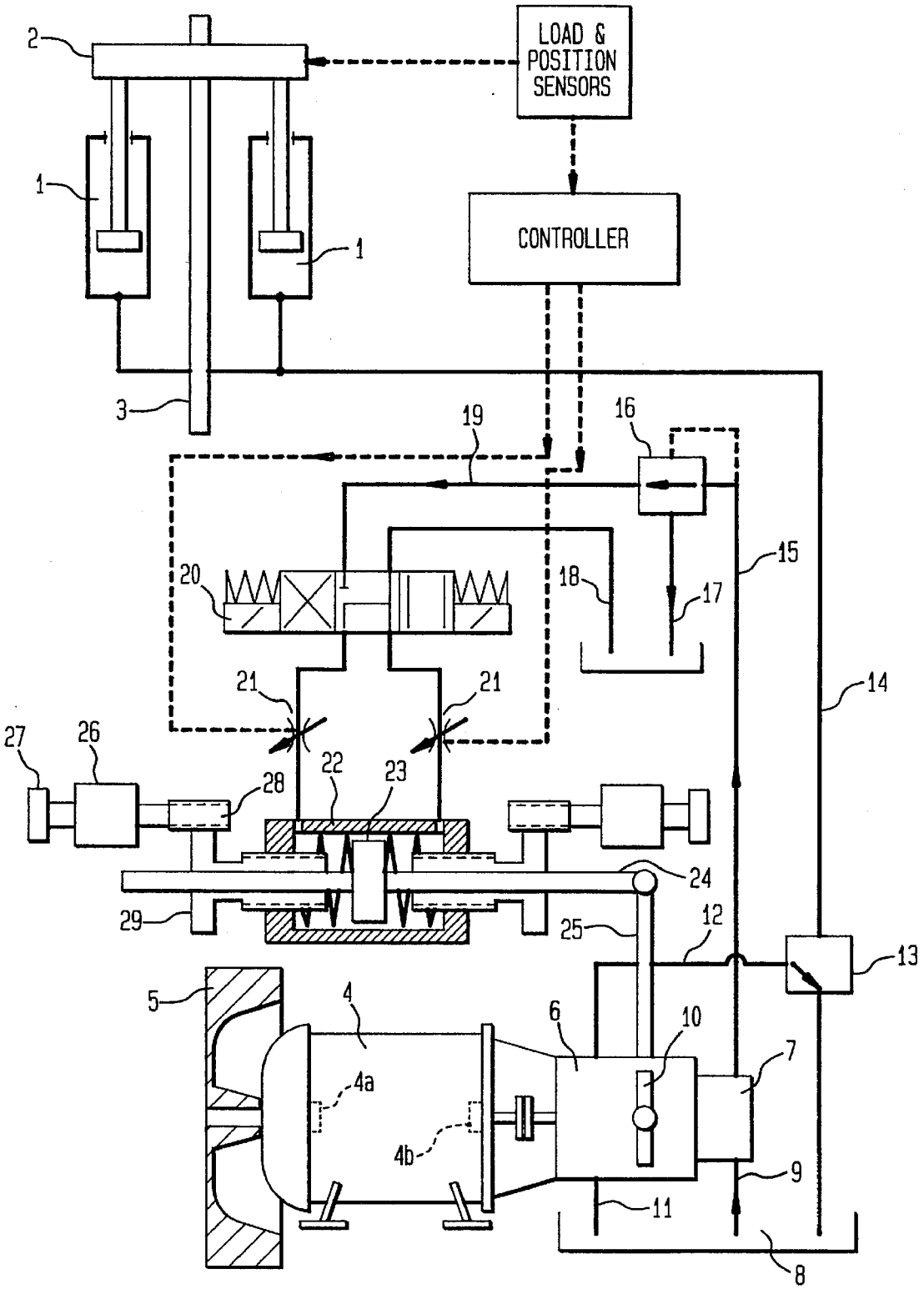
FIG. 1 is a schematic diagram of an hydraulic pumping unit constructed in accordance with the present invention, illustrating rod strings of the hydraulic pumping unit at rest.

At FIG. 1, the Hydraulic Pumping Unit is shown in its rest position. The piston rods of the two hydraulic cylinders (1) are coupled rigidly with the help of the sincronizer (2), assuring in this way the simultaneous and uniform movement of the two piston rods. The polished rod (3) of the rod string is fixed at the center of the synchronizer (2). At the lower part of FIG. 1 the electric motor (4), coupled on one side with the flywheel (5) and on the other side with the reversible hydraulic pump (6) and the ancillary pump (7) is represented.

To understand better the working of the assembly composed by flywheel (5), electric motor (4) and reversible pump (6), it must be mentioned that the electric motor (4) is a high-slip motor, as specified by NEMA D. The hydraulic pump (6), in turn, is of the reversible swash-plate type, This means that the pump (6) moves hydraulic oil from the oil reservoir to the hydraulic cylinders (1) if the swash-plate (10) is tilted to the right, and that the same pump (6) functions as an hydraulic motor if the swash-plate (10) is tilted to the left and the hydraulic oil returns from the cylinders (1) to the reservoir. As represented in FIG. 1, the position of the swash-plate is vertical, without inclination to the left or to the right, so that in this position no hydraulic oil is moved, and the hydraulic cylinders (1) are at rest. It is important to point out that the assembly of flywheel (5), electric motor (4) and hydraulic pump (6) forms one solid block, using only the two bearings (*4a, 4b*) of the electric motor (4) and forcing in this way the perfect alignment of the assembly.

The positioning of the swash-plate (10) is performed with the aid of the lever (25), which in turn receives his movement from the red (24) of the piston (23). As shown in FIG. 1, the piston (23) is centered within the adjusting cylinder (22).

Coupled face-to-face with the reversible pump (6) is the ancillary pump (7) which pumps continuously the hydraulic oil for the adjustment of the swash-plate (10) from the reservoir (8), the suction tube (9) and the pressure tube (15) to the electromagnetic directional valve (20). In the position shown in FIG. 1, the directional valve (20) is in its central position, closing in this way the outlet of tube (19). In this position, a pressure regulating valve (16) discharges the oil from the ancillary pump (7) to the discharge tube (17) and back to the reservoir (8).

Figure 2:
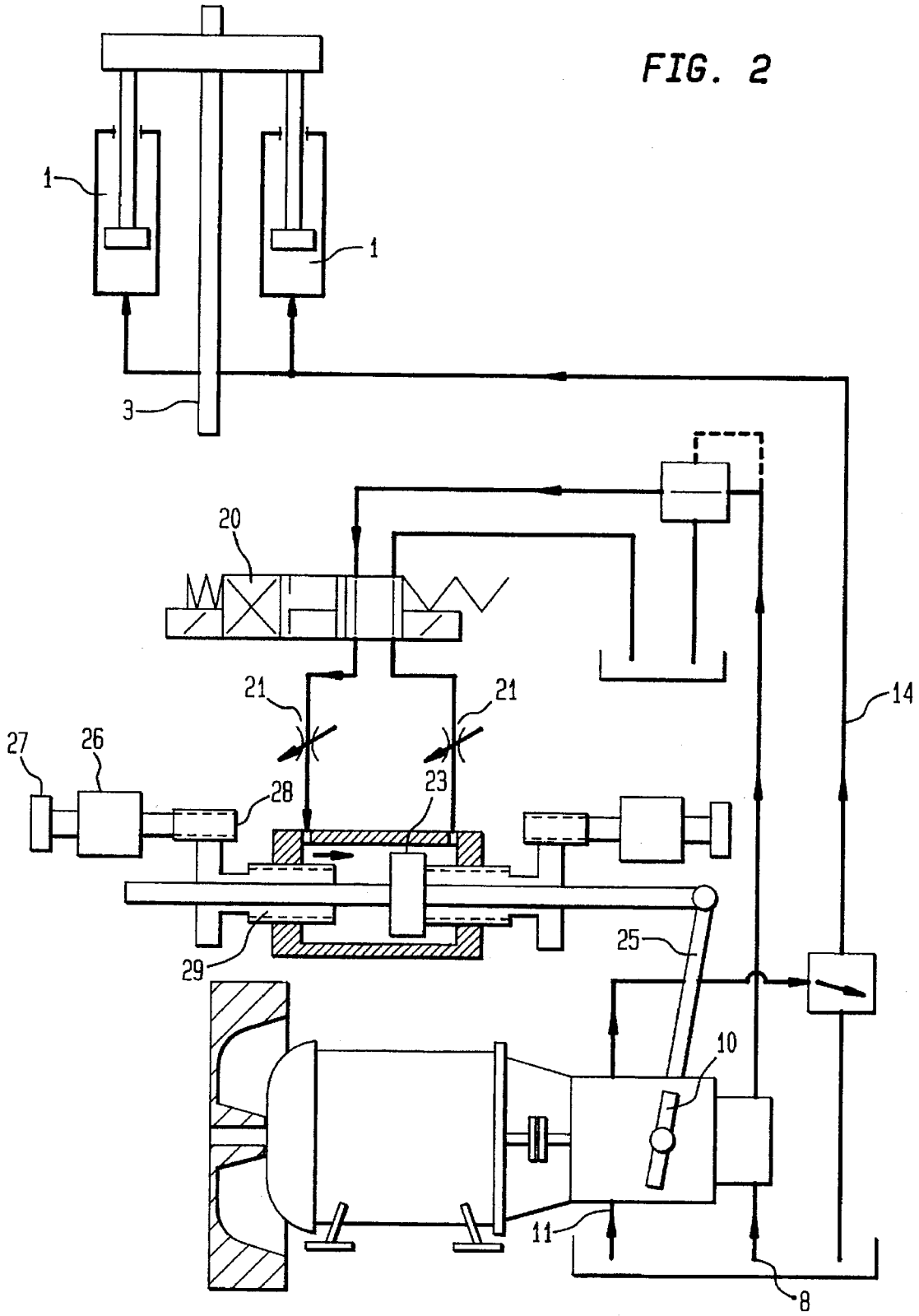
FIG. 2 is a schematic diagram of the hydraulic pumping unit shown in FIG. 1 during the upward movement of the rod strings.

FIG. 2 shows the positions of the control system during the upward move of the rod string. With the aid of an electric signal coming from an limit switch (not represented in the FIG. 2) the magnetic coil on the left side of the electromagnetic directional valve (20) moves the spool of this valve to the position shown in FIG. 2. With this, the hydraulic oil coming from the ancillary pump (7,FIG. 1) can pass to the adjusting cylinder (20,FIG. 1) and move the piston (23) in the direction indicated by the arrow. The oil on the opposite side of piston (23) can pass through the tube (18) to the reservoir. The lever (25) tilts in consequence the swash-plate (10) of the pump (6,FIG. 1) to the right, so that this pump can move hydraulic oil through the suction tube (11), the pressure tube (12,FIG. 1) and the tube (14) to the lower side of the cylinders (1), starting in this way the upward movement of the rod string. When the cylinders (1) reach the upper reversal point, a second electric signal moves the spool of the electromagnetic directional valve (20) to the position shown in FIG. 3.

Figure 3:
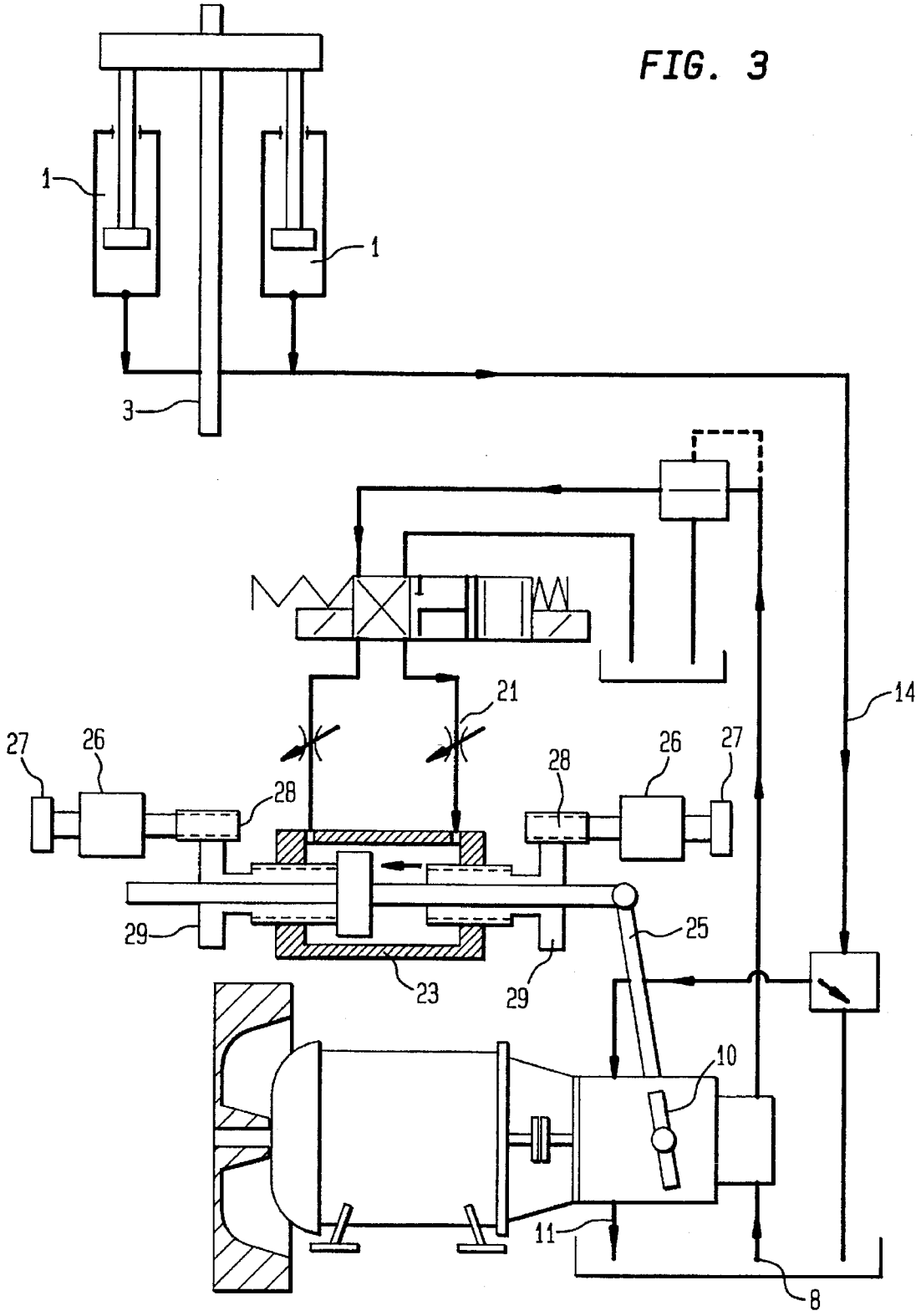
FIG. 3 is a schematic diagram of the hydraulic pumping unit shown in FIG. 1 during the downward movement of the rod strings.

In consequence, the hydraulic oil, coming from the ancillary pump (7,FIG. 1) moves the piston (23,FIG. 1) to the position indicated by the arrow in FIG. 3 and the lever (25) tilts the swash-plate (10,FIG. 1) to the left, so that the reversible pump (6,FIG. 1) now functions as an hydraulic motor. With the aid of the synchronizer (2,FIG. 1) the weight of the rod string pushes the hydraulic oil contained in the cylinders (1), through the tubes (14 and 12,FIG. 1) to the hydraulic pump (6,FIG. 1) which now acts as an hydraulic motor, accelerating the rotation of the electric motor (4,FIG. 1) and the flywheel (5,FIG. 1). When the cylinders (1) reach the lower point of reversal, the cycle starts again with the situation represented in FIG. 2. The adjustment of the upward and downward speeds as much as the acceleration and deceleration are done by components numbered in FIG. 1, As can be seen in FIG. 1, the hydraulic oil which moves the piston (23) must pass one of the two flow or speed regulation valves (21), adjusting in this way the speed with which the swash-plate (10) moves during the change from pump to motor function of the pump (6), determining at the same time the speed of reversal of the cylinders (1).

The upward and the downward speed are proportional to the angle of tilting of the swash-plate (10), which can be adjusted with the regulating screws (29), either manually with the adjusting knobs (27) or electrically with the help of the step-motors (26) and the reduction gears (28). The step-motors (26) allow the adjustment of up and down speed by electric impulses received from a micro computer, making it in this way possible to adjust the working conditions of the Hydraulic Pumping Unit to the changing conditions of the oilwell. In this way, the so called "intelligent pumping" can be implemented without difficulties.

The pressure regulating valve (13) serves to protect the rod string against overloads, limiting the hydraulic pressure to any adjusted value.

The system described above solves at the same time the task of balancing the Hydraulic Pumping Unit. The balancing consists in the recuperation of the energy of the rod string during its down moving.

Figure 4:
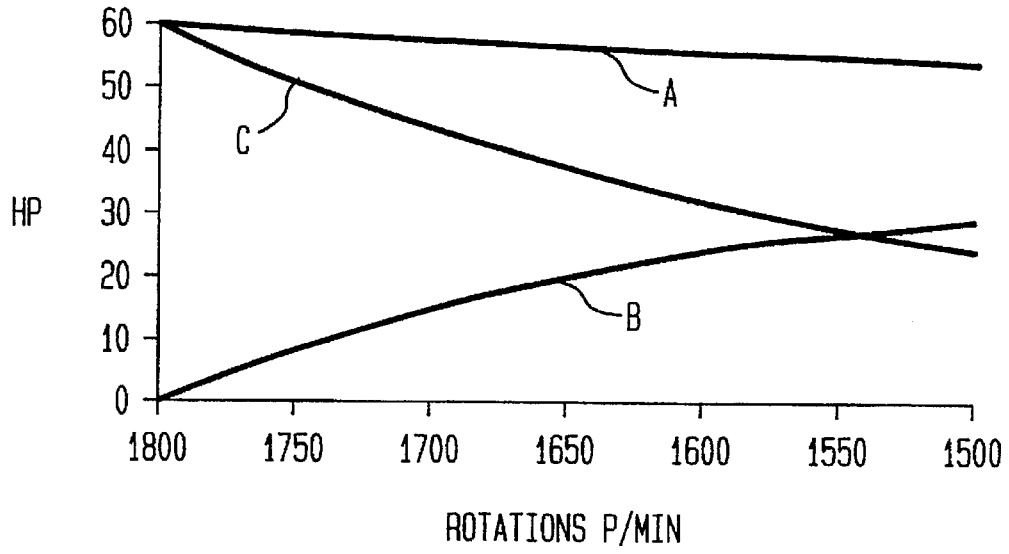
FIG. 4 is a graph illustrating power required by the hydraulic pumping unit during the upward movement of the rod strings.

The present invention uses the assembly flywheel—motor—hydraulic pump to perform this recuperation in the way explained as follows. Using as example the typical conditions of an oilwell, the total power necessary during the upward movement of the rod string is represented by the curve (A) of FIG. 4. The electric motor of the Hydraulic Pumping Unit, which rotates at the start with 1800 rpm, only has the power represented by the curve (B) of FIG. 4. The difference between the power necessary and the power available at the electric motor is supplied by the kinetic energy accumulated in the flywheel. It can be seen at FIG. 4, that the number of rotation of the assembly during the upward movement dropped from 1800 rpm to 1500 rpm. The high-slip motor used in this invention allows this variation of speed. Due to this reduction of rotational speed, the flywheel can develop the power represented at curve (C), FIG. 4 and complement the power needed by the hydraulic pump.

Figure 5:
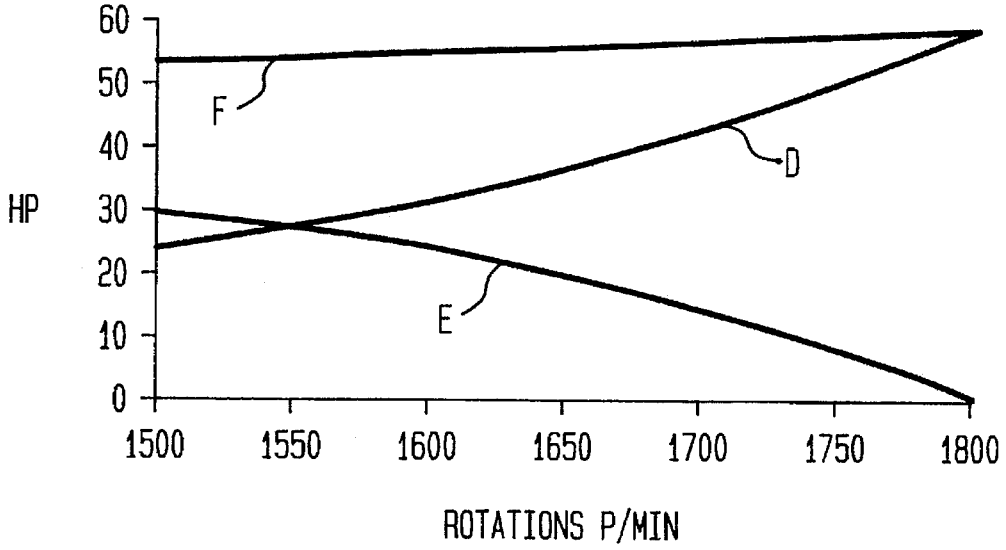
FIG. 5 is a graph illustrating power required by the hydraulic pumping unit during the downward movement of the rod strings.

During the downward movement of the rod string, the hydraulic oil coming from the cylinders causes the hydraulic pump to work as an hydraulic motor, producing the power represented at the curve (D) of FIG. 5, accelerating again the flywheel. To reach the initial speed of 1800 rpm, the flywheel need the power represented by the curve (F), FIG. 5. The difference between the total power necessary (F) and the power recuperated from the rod string (D) is shown by curve (E), FIG. 5, and is supplied by the electric motor.

In accordance with the specific conditions of the oilwell, the range of the speed changes during the upward and the downward movement is self adjusting, up to the speed of synchronism of the electric motor.

The system of balancing used in the present invention uses the recuperation of the kinetic energy of the flywheel instead of the static energy accumulated by pressurized gas.

The system is self-adjusting and completely maintenance free.

I claim:

1. An hydraulic pumping unit for actuating a rod string, comprising:

a high-slip electric motor; a flywheel coupled to one side of the electric motor; and a reversible hydraulic pump coupled to another side of the electric motor for the balancing and recuperation of the energy produced by downward movement of the rod string, the reversible hydraulic pump acting as an hydraulic motor during the downward movement of the rod string and accelerating the flywheel for storing the energy of the downward movement of the rod string as kinetic energy.

2. The hydraulic pumping unit of claim 1, wherein the kinetic energy stored in the flywheel supplements the power of the electric motor during upward movement of the rod string.

3. An hydraulic pumping unit, comprising: a flywheel; an electric motor; and an hydraulic pump, the flywheel, the electric motor and the hydraulic pump being coupled to a shaft of the electric motor and using only the bearings of the electric motor for rotational guidance, thereby assuring alignment between the flywheel, the electric motor and the pump.

4. An hydraulic pumping unit for actuating a rod string, comprising: speed regulating hydraulic valves for adjusting upward and downward speed of the rod string, the valves being adjustable by hand or by step motors which function as actuators for actuating the valves upon receiving commands from a computer based upon data from load and position sensors so as to adjust the speed in accordance with changing conditions in an associated well.

5. An hydraulic pumping unit for actuating and reciprocating a rod string, comprising: two independent flow regulating valves; art electrically controlled directional valve; and an hydraulic adjusting cylinder, the regulating valves being positioned between the directional valve and the cylinder for adjusting the acceleration and deceleration at reversal points of movement of the rod string.

* * * * *